US005757319A

United States Patent [19]

Loo et al.

[11] Patent Number: 5,757,319

[45] Date of Patent: May 26, 1998

[54] ULTRABROADBAND, ADAPTIVE PHASED ARRAY ANTENNA SYSTEMS USING MICROELECTROMECHANICAL ELECTROMAGNETIC COMPONENTS

[75] Inventors: Robert Y. Loo; Juan F. Lam, both of Agoura Hills; Vince L. Jones, Simi Valley; Jar J. Lee, Irvine; Darren E. Atkinson, La Habra, all of Calif.

[73] Assignee: Hughes Electronics Corporation, El Segundo, Calif.

[21] Appl. No.: 740,409

[22] Filed: Oct. 29, 1996

[51] Int. Cl.[6] ..... H01Q 3/22

[52] U.S. Cl. ..... 342/375; 333/144; 333/139; 333/262

[58] Field of Search ..... 342/375; 333/139, 333/144, 164, 261, 262

[56] References Cited

U.S. PATENT DOCUMENTS

| | | | |
|---|---|---|---|
| 4,682,128 | 7/1987 | Sproul et al. | 333/139 |
| 4,814,774 | 3/1989 | Herczfeld | 342/372 |
| 4,894,626 | 1/1990 | Kubinec | 333/101 |
| 5,121,089 | 6/1992 | Larson | 333/107 |
| 5,164,688 | 11/1992 | Larson | 333/33 |
| 5,168,249 | 12/1992 | Larson | 333/81 |
| 5,175,521 | 12/1992 | Larson | 333/235 |
| 5,263,004 | 11/1993 | Larson, III | 367/7 |
| 5,339,087 | 8/1994 | Miharik | 342/375 |
| 5,400,037 | 3/1995 | East | 342/372 |
| 5,475,392 | 12/1995 | Newberg et al. | 342/375 |

OTHER PUBLICATIONS

"Microactuators for Ga–As–Based Microwave Integrated Circuits," L.E. Larson et al., *Transducer '91*, Digest of the International Conference on Solid–State Sensors and Actuators, pp. 743–746.

"The Integration of Micro–Machine Fabrication with Electronic Device Fabrication on III–V Semiconductor Materials," R.H. Hackett et al., *Transducer '91*, Digest of the International Conference on Solid–State Sensors and Actuators, pp. 51–54.

*Primary Examiner*—Thomas H. Tarcza
*Assistant Examiner*—Dao L. Phan
*Attorney, Agent, or Firm*—V. D. Duraiswamy; W. K. Denson-Low

[57] ABSTRACT

A phased array radar system employs programmable microelectromechanical (MEM) switches and transmission lines to provide true time delays or phase shifts in order to steer the array beam. The array includes an excitation signal source, a power division network for dividing the excitation signal into a plurality of excitation signal components, a plurality of programmable time delay/phase shift circuits including the transmission lines and MEM switches, and a plurality of radiating elements. An adaptive controller provides the control signals to set the MEM switches and select the time delay/phase shift through each time delay/phase shift circuit, thereby steering the array beam to a desired direction.

10 Claims, 3 Drawing Sheets

ULTRABROADBAND, ADAPTIVE PHASED ARRAY ANTENNA SYSTEMS USING MICROELECTROMECHANICAL ELECTROMAGNETIC COMPONENTS

TECHNICAL FIELD OF THE INVENTION

This invention relates to phased array radar systems, and more particularly to a phased array radar system capable of extremely broadband operation.

BACKGROUND OF THE INVENTION

There are two methods to accomplish beam steering in a phased array radar. One method is to use phase shifters and the second method is to perform true time delay with delay lines. Presently the microwave phase shifters employ PIN diodes or ferrite material. These PIN diodes have limited bandwidth, and there will be a phase shift whenever there is a change of frequency. This phase shift in turn will lead to radar pointing errors and beam squint. This is an undesirable phenomenon in radar. Thus, the conventional phase shifters will limit the radar to a narrow frequency band. PIN diodes require a holding current for operation, with attendance reactance and loss. PIN diodes are reactive, leaky and have relatively high loss at operation above 10 GHz. For this reason, PIN diodes are generally not used at frequencies above 10 GHz. Instead, MMIC FET switches are typically used at frequencies above 10 GHz, but these switches are quite lossy, are biased by current, and tend to current leakage in the "off" state, so that the "off" state is not truly off or open. Expensive circuitry is required to address these problems of the FET switches.

Still, today many radars use these PIN diode and FET—based phase shifters because microwave waveguides and cables used to obtain true time delay beam steering are very bulky and space consuming. Ferrite materials are bulky and expensive for lower frequency devices operating below 10 GHz, and are difficult to machine for higher frequency devices.

SUMMARY OF THE INVENTION

A phased array radar system is described which is capable of broadband operation. The system includes an excitation signal source, an antenna array comprising a plurality of radiating elements, and an excitation signal power divider network for dividing the excitation signal into a plurality of signal components. The system further includes a plurality of adjustable time delay/phase shift circuits, wherein the time delay/phase shift introduced by each circuit is programmably determined in response to control signals. Each time delay/phase shift circuit is connected to provide an RF signal transmission path between the power division network and a corresponding radiating element. An adaptive controller generates the control signals which programmably control the instantaneous setting of the respective time delay/phase shift circuits.

In accordance with the invention, each time delay/phase shift circuit comprises a network of transmission lines and a plurality of microelectromechanical (MEM) switches, each having respective open and closed states, and wherein the particular pattern of settings of the switch states configures the transmission line network to a corresponding delay line length or phase shift setting. With the MEM-based time delay/phase shift circuits, the array is capable of extremely broadband operation, from 2 GHz to the millimeter wave regime above 30 GHz. The MEM circuits have low electromagnetic insertion loss, with high isolation capabilities.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
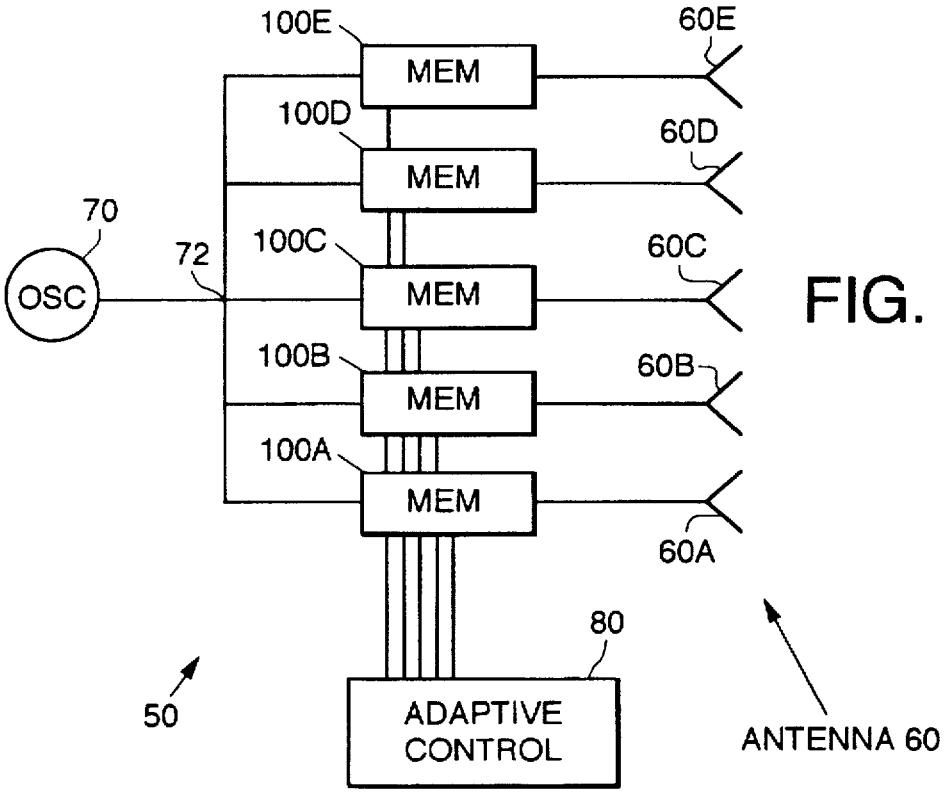
FIG. 1 is a simplified block diagram of an MEM-based adaptive phased array radar system embodying this invention.

FIG. 1 shows a microelectromechanical (MEM)-based adaptive phased array antenna system 50 embodying the present invention. The system includes an antenna array 60 comprising a plurality of radiating elements 60A–60E. While only a five-element array is illustrated in FIG. 1, it is to be understood that the number of elements actually used in a particular system application will depend on the particular requirements of that application. Many applications will require large antenna arrays with hundreds or even thousands of radiating elements.

The system 50 further includes a transmitter oscillator circuit 70 which provides the excitation signal for the system 50. This signal is in turn passed to power divider 72, which splits the signal into signal components passed to true-time-delay or phase shifter circuits 100A–100E, and then to the corresponding radiating elements 60A–60E. The true-time-delay or phase shifting provided by circuits 100A–100E results in generation of a beam steered to a particular direction, as is well understood in the phased array art.

The particular time delay or phase shift provided by each circuit 100A–100E is controlled by the system adaptive control unit 80.

Figure 2:
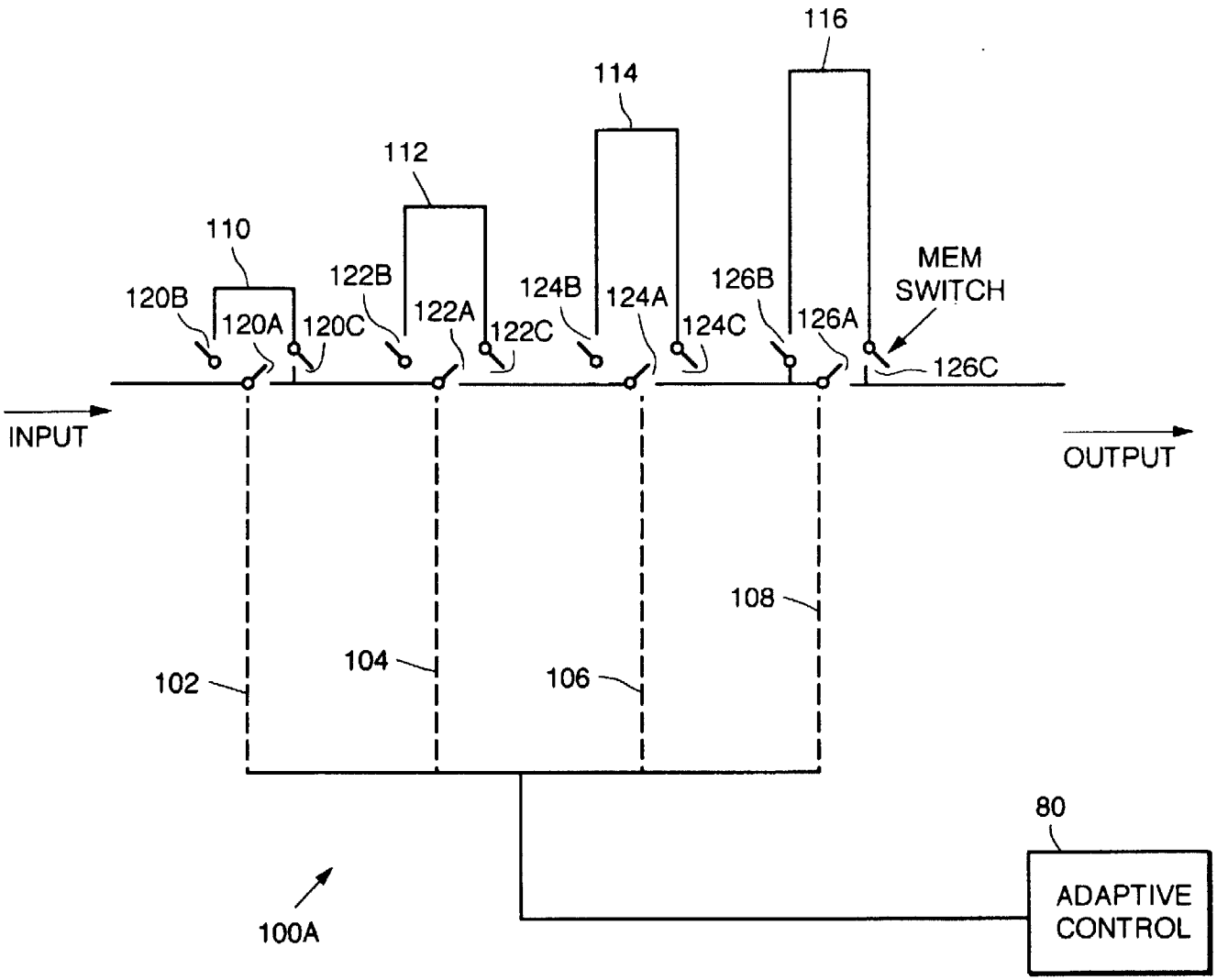
FIG. 2 is a simplified block diagram of an exemplary 4-bit true-time-delay circuit comprising the system of FIG. 1 and employing MEM switches in accordance with the invention.

FIG. 2 illustrates exemplary true-time-delay circuit 100A; each of the other true-time-delay circuits 100B–100E will be identical to circuit 100A. The circuit 100A includes a network of delay lines interconnected by MEM switches. By opening and closing the MEM switches in a particular manner, any of the delay lines can be selected, thereby establishing a particular time delay for the circuit. The circuit 100A is a 4-bit circuit, in that there are 4 binary valued control lines 102–108, each having binary-valued states, to control the MEM switches for a corresponding delay line 110–116. Thus, to bypass delay line 110, MEM switch 120A is closed, and MEM switches 120B and 120C are opened. To pass the signal through the delay line 110, switch 120A is opened, and switches 120B and 120C are closed. Thus, the state of switch 120A will be set to the opposite state of switches 120B and 120C, permitting a single bit line to control the setting of the set of MEM switches 120A–120C for the delay line 110. Similarly, to bypass delay line 112, switch 122A is closed, and switches 122A and 122C are opened. To pass the signal through the delay line 112, switch 122A is opened, and switches 122B and 122C are closed. To bypass delay line 114, switch 124A is closed, and switches 124B and 124C are opened. To pass the signal through line 114, switch 124A is opened, and switches 124B and 124C are closed. To bypass delay line 116, switch 126A is closed, and switches 126B and 126C are opened. To pass the signal through the line 116, switch 126A is opened, and switches 126B and 126C are closed.

The adaptive control unit 80 selects which of the delay lines 110–116 are to be bypassed for setting the beam steering for a given beam angle and frequency of operation. Since there are four independently controllable lines set in series connection, there are sixteen different combinations of settings, and thus sixteen possible time delay settings for the circuit 100A.

The conventional PIN diode phase shifter suffers from beam squint problems, which limit the frequency bandwidth of the radar. By replacing the PIN diode phase shifter circuit with an MEM-based true-time-delay or phase shifter circuit, this drawback can be alleviated. The MEM switches are broadband and have low insertion loss.

The fabrication process for MEM switches is quite standard using today's photolithographic technology on a silicon or any ceramic substrate. The process requires metallizations, plating and a thick sacrificial photoresist layer. The design and fabrication of MEM switches suitable for the purpose are described in "Microactuators for GaAs-Based Microwave Integrated Circuits," Lawrence E. Larson et al., IEEE proc. Transducers 1991, at pages 743–746; "The Integration of Micro-Machine Fabrication with Electronic Device Fabrication on III-V Semiconductor Materials," R. H. Hackett et al., IEEE proc. Transducers 1991, at pages 51–54.

Figure 3:
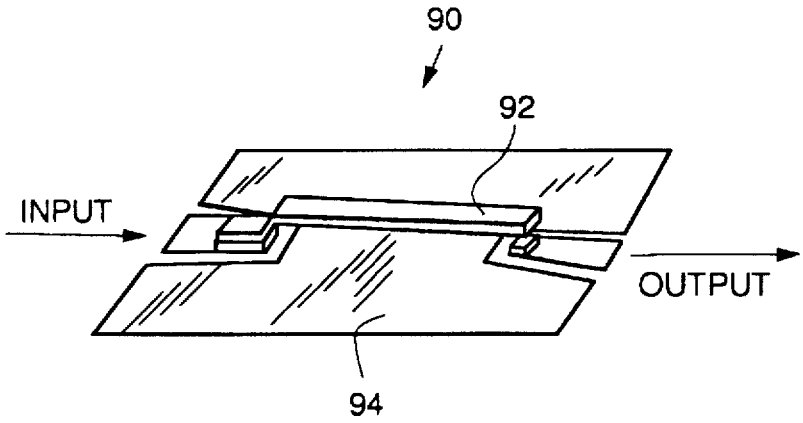
FIG. 3 is a schematic isometric diagram illustrating an exemplary form of a MEM switch suitable for use in the array of FIG. 1.

FIG. 3 is a schematic isometric diagram illustrating an exemplary form of a MEM switch 90 suitable for use in the array 50 of FIG. 1. As shown therein, and more particularly described in Larson et al., "Microactuators for GaAs-Based Microwave Integrated Circuits," id., this exemplary type of switch is a cantilevered beam micro-machined "bendable" switch. Applying a dc voltage between the beam 92 and the ground plane 94 closes the switch 90. Removing the voltage opens the switch.

Figure 4:
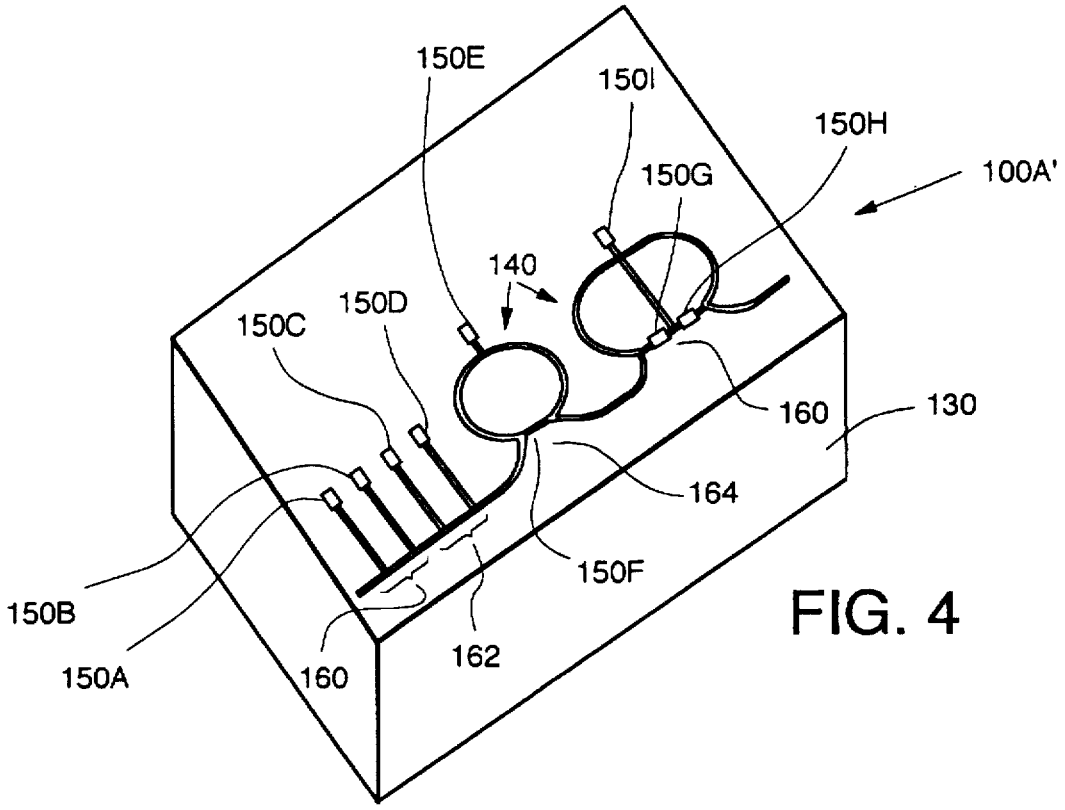
FIG. 4 is an isometric view of a phase shift circuit implemented with MEM switches on a ceramic substrate.

The MEM switches can be fabricated with microstrip delay lines or phase shift circuits integrated on a common ceramic module. FIG. 4 is an isometric view of a 4-bit phase shift circuit 100A' implemented with MEM switches on a ceramic substrate 130. This circuit can replace the time delay circuit 100A of FIG. 2. MEM switches are employed to select 22 degree, 45 degree, 90 degree and 180 degree phase shift increments. A microstrip transmission line conductor pattern 140 is formed on the surface of the dielectric substrate 130. MEM switches 150A–150D control the 22 degree and 45 degree phase shift sections 160 and 162, respectively. MEM switches 150E and 150F control the 90 degree phase shift section 164. MEM switches 150H–150I control the 180 degree phase shift section 166. The architecture of the circuit 110A' has been employed with PIN diodes; in this embodiment, the MEM switches have replaced the PIN diodes.

Figure 5:
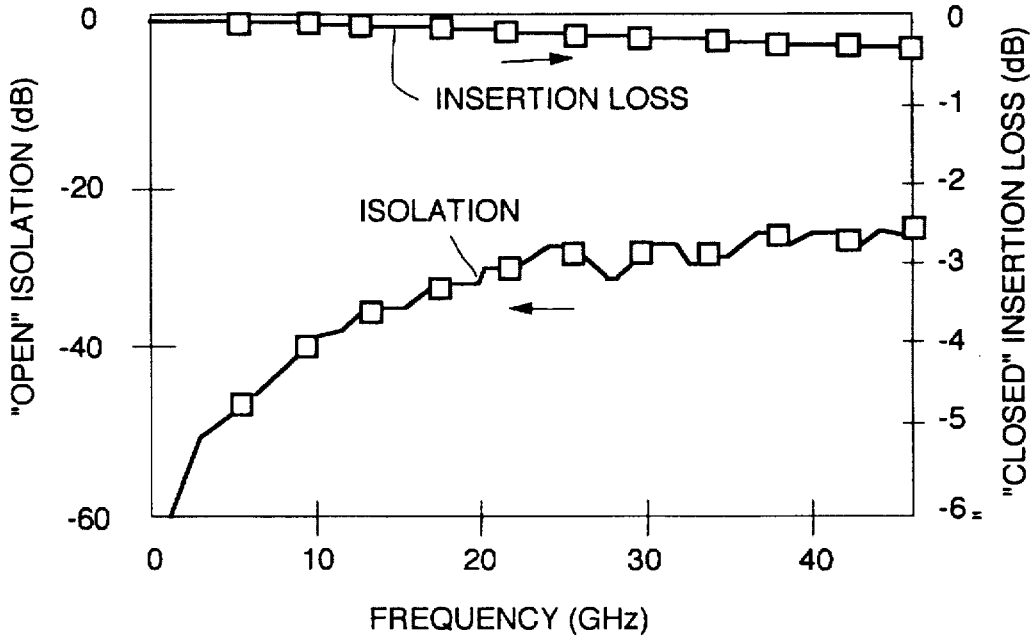
FIG. 5 is a graph plotting measured values for the closed state insertion loss and the open state isolation of an exemplary MEM switch over a broad frequency range.

An important advantage of the MEM switch is its low loss over a wide frequency range. FIG. 5 is a graph plotting measured values for the closed state insertion loss and the open state isolation of an exemplary MEM switch over a broad frequency range, showing that the MEM device is broadband and the RF insertion loss is less than 1 dB at frequencies as high as 50 GHz. Table 1 sets out exemplary performance and characteristic data for a four-bit MEM-based time delay/phase shift device in accordance with the invention.

TABLE 1

| Parameter | Performance |
|---|---|
| No. of phase bits | 4: 180, 90, 45, 22.2 degrees |
| Frequency | 14–15 GHz |
| Insertion Loss | <3.0 dB at 14.5 GHz |
| Return Loss | < −15 dB, all states 14.5 GHz |
| Bias Voltage | 10 to 40 V |
| Bias Current | 0 |
| RF Power | >10 mWatts |
| Switching Time | 10–20 microseconds |
| Size | <2 mm square |

A phased array radar system has been described which is capable of extremely broadband operation, e.g.in exemplary applications on the order of 2–45 GHz, yet with significantly reduced power consumption over conventional phased array systems. The applications for which the invention is particularly useful include those employing frequencies above 10 GHz, and the millimeter wave applications. The MEM components can be designed to have a net electromagnetic insertion loss significantly lower than losses associated with PIN diode switches. For example, an MEM-based 4-bit true-time delay or phase shifter operating at 20 GHz can be designed to have a maximum net loss of 1.6 dB, as compared to a typical loss of 8–10 dB for a PIN diode based phased shifter.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A phased array radar system capable of broadband operation at frequencies above 10 GHz, comprising:

an excitation signal source for providing excitation signals at frequencies above 10 GHz;

an antenna array comprising a plurality of radiating elements;

an excitation signal power divider network for dividing the excitation signal into a plurality of signal components;

a plurality of adjustable time delay circuits, wherein the time delay introduced by each circuit is programmably determined in response to control signals, wherein each time delay circuit is connected to provide an RF signal transmission path between the power division network and a corresponding radiating element;

an adaptive controller for generating the control signals which programmably control the instantaneous setting of the respective time delay circuits; and wherein each time delay circuit comprises a network of delay transmission lines and a plurality of microelectromechanical (MEM) switches, each fabricated on a substrate, each MEM switch capable of broadband operation with low insertion loss at frequencies above 10 GHz, each MEM switch having respective open and closed states, and wherein the particular pattern of settings of the switch states configures the delay line network to a corresponding delay line length.

2. The system of claim 1 wherein said network of delay transmission lines comprises a plurality of delay lines selectively connectable in a series arrangement along said RF signal transmission path, each of said delay lines having associated therewith a set of MEM switches to control the bypassing or connecting of the delay line into the signal path.

3. The system of claim 2 wherein each said set of MEM switches includes first, second and third MEM switches, said first MEM switch being closable and said second and third switches being openable to bypass the delay line associated with the MEM switch set, the first switch being openable and said second and third switches being closable to connect said delay line into the signal path.

4. The system of claim 1 wherein each time delay circuit comprises a ceramic substrate, and said network of delay transmission lines and said plurality of MEM switches are fabricated on said substrate.

5. A phased array radar system capable of broadband operation at frequencies above 10 GHz, comprising:

an excitation signal source for generating excitation signals above 10 GHz;

an antenna array comprising a plurality of radiating elements;

an excitation signal power divider network for dividing the excitation signal into a plurality of signal components;

a plurality of adjustable phase shift circuits, wherein the phase shift introduced by each circuit is programmably determined in response to control signals, wherein each phase shift circuit is connected to provide an RF signal transmission path between the power division network and a corresponding radiating element;

an adaptive controller for generating the control signals which programmably control the instantaneous setting of the respective phase shift circuits; and wherein each phase shift circuit comprises a network of transmission lines and a plurality of microelectromechanical (MEM) switches, each fabricated on a substrate, each MEM switch capable of broadband operation at frequencies above 10 GHz, each MEM switch having respective open and closed states, and wherein the particular pattern of settings of the switch states configures the phase shift circuit to a corresponding phase shift value.

6. The system of claim 5 wherein each phase shift circuit comprises a ceramic substrate, and said network of transmission lines and said plurality of MEM switches are fabricated on said substrate.

7. The system of claim 1 wherein each said MEM switch has an insertion loss characteristic which is less than 1 dB over a broadband frequency range of operation extending from 10 GHz to 45 GHz.

8. The system of claim 1 wherein said substrate is a silicon or ceramic substrate.

9. The system of claim 5 wherein each said MEM switch has an insertion loss characteristic which is less than 1 dB over a broadband frequency range of operation extending from 10 GHz to 45 GHz.

10. The system of claim 5 wherein said substrate is a silicon or ceramic substrate.

* * * * *